US008794375B2

(12) United States Patent
Jung et al.

(10) Patent No.: US 8,794,375 B2
(45) Date of Patent: Aug. 5, 2014

(54) ASSEMBLY OF TELESCOPIC PIPE SECTIONS

(75) Inventors: Boudewijn Casper Jung, Bergen op Zoom (NL); Jan Albert Westerbeek, Spijkenisse (NL)

(73) Assignee: IHC Holland IE B.V. (NL)

( * ) Notice: Subject to any disclaimer, the term of this patent is extended or adjusted under 35 U.S.C. 154(b) by 44 days.

(21) Appl. No.: 13/502,067

(22) PCT Filed: Oct. 8, 2010

(86) PCT No.: PCT/NL2010/050667

§ 371 (c)(1),
(2), (4) Date: Jun. 8, 2012

(87) PCT Pub. No.: WO2011/046430

PCT Pub. Date: Apr. 21, 2011

(65) Prior Publication Data

US 2012/0241039 A1 Sep. 27, 2012

(30) Foreign Application Priority Data

Oct. 16, 2009 (NL) ..... 2003656

(51) Int. Cl.

| | |
|---|---|
| ***G10K 11/16*** | (2006.01) |
| ***F16F 15/08*** | (2006.01) |
| ***E02D 13/04*** | (2006.01) |
| *G10K 11/00* | (2006.01) |
| *F16F 15/00* | (2006.01) |
| *E02D 13/00* | (2006.01) |

(52) U.S. Cl.
USPC ..... 181/205; 181/209; 405/232

(58) Field of Classification Search
CPC ..... E02D 7/14; E02D 13/00; F16L 9/22; F16L 9/21; E21B 47/011; G10K 11/16
USPC ..... 181/198, 205, 110, 105, 121, 120, 207, 181/209; 405/228, 224, 216, 232; 367/1; 173/DIG. 2; 138/155; 137/15.01
See application file for complete search history.

(56) References Cited

U.S. PATENT DOCUMENTS 1,240,521 A * 9/1917 Wendland ..... 248/578
2,136,315 A * 11/1938 Pettit ..... 299/37.4

(Continued)

FOREIGN PATENT DOCUMENTS

CH 319 875 3/1957
DE 22 37 133 2/1974

(Continued)

OTHER PUBLICATIONS

DE 2237133 Translation Document; no date.*

(Continued)

*Primary Examiner* — Edgardo San Martin
(74) *Attorney, Agent, or Firm* — Meyer IP Law Group

(57) ABSTRACT

The present invention relates to a device for passively reducing the noise vibrations in a liquid resulting from a sound source which is arranged below the liquid level of a body of water, the device comprising a noise-insulating pipe which is designed to be arranged around the sound source, wherein the pipe comprises a number of telescopically extendable and retractable pipe sections, fastening means for attaching at least one first and one second pipe section to one another in extended and/or retracted position, wherein the fastening means are designed to allow the mutual displacement of the pipe sections in a starting position and to attach the pipe sections to one another in a fastening position, and wherein the fastening means are also designed to keep the first and second pipe sections substantially acoustically disconnected in the fastening position.

23 Claims, 6 Drawing Sheets

(56) References Cited

U.S. PATENT DOCUMENTS

| | | | | | |
|---|---|---|---|---|---|
| 3,586,122 | A * | 6/1971 | Jacke | 181/205 |
| 3,638,737 | A * | 2/1972 | Moates | 173/60 |
| 3,757,891 | A * | 9/1973 | Krieger | 181/205 |
| 3,975,918 | A * | 8/1976 | Jansz | 405/232 |
| 4,040,492 | A * | 8/1977 | Frederick | 173/1 |
| 4,124,987 | A * | 11/1978 | Hallman et al. | 405/276 |
| 4,766,708 | A * | 8/1988 | Sing | 248/585 |
| 4,856,938 | A * | 8/1989 | Kuehn | 405/227 |
| 5,839,517 | A * | 11/1998 | Gwinn et al. | 173/162.2 |
| 6,199,656 | B1 * | 3/2001 | Vento et al. | 181/200 |
| 6,612,782 | B1 * | 9/2003 | Tengan | 405/249 |
| 7,476,056 | B2 * | 1/2009 | Dreyer | 405/228 |
| 7,730,973 | B2 * | 6/2010 | Haglund | 175/162 |
| 7,861,804 | B2 * | 1/2011 | Haglund | 175/325.1 |
| 8,061,449 | B2 * | 11/2011 | Haglund | 175/162 |
| 8,387,746 | B2 * | 3/2013 | Parkin | 181/290 |
| 8,500,369 | B2 * | 8/2013 | Mohr | 405/232 |
| 2005/0083783 | A1 * | 4/2005 | Baskerville et al. | 367/1 |
| 2011/0031062 | A1 * | 2/2011 | Elmer | 181/175 |

FOREIGN PATENT DOCUMENTS

| | | | | |
|---|---|---|---|---|
| DE | 29 15 542 | | 8/1980 | |
| DE | 10 2006 008095 | | 8/2007 | |
| JP | 57 193734 | | 12/1982 | |
| JP | 60159218 | A * | 8/1985 | E02D 13/00 |
| JP | 03137316 | A * | 6/1991 | E02D 7/16 |

OTHER PUBLICATIONS

Japanese Patent Office, Office Action for Japanese Patent Application No. 2012-534136, Jan. 28, 2014, 9 pages.

Chinese Patent Office, Office Action for Chinese Patent Application No. 201080046690.4, Jan. 24, 2014, 24 pages.

* cited by examiner

ASSEMBLY OF TELESCOPIC PIPE SECTIONS

CROSS-REFERENCE TO RELATED APPLICATIONS

The present application claims priority to International Patent Application No. PCT/NL2010/050667 filed Oct. 8, 2010, by Jung, et al., which claims priority to Netherlands Patent Application No. NL2003656 filed Oct. 16, 2009, which applications are herein incorporated by reference.

BACKGROUND

The present invention relates to a device for passively reducing the noise vibrations in a liquid resulting from a sound source which is arranged under the liquid level of a body of water, in which the device comprises a noise-insulating pipe which is designed to be arranged around the sound source. The invention also relates to a method for operating such a device.

During activities below the water level of a body of water, for example below the water surface of a sea, river or lake, relatively high noise levels may be generated which can be damaging to animals or humans present in the vicinity. When, for example, ramming has to be carried out underwater, in which case a pile element, such as for example a pile, is driven into the ground by means of a pile-driving device which is situated above water, very high noise levels may occur underwater. As the noise is generated underwater, the sound waves will be audible at a much greater distance from the sound source than would be the case if the sound source were placed above water. In practice, it has been found that during pile-driving work, it is not possible to carry out any other underwater activities in the vicinity, that is to say within a radius of a kilometer or more, which require the use of divers underwater. Other sound sources than a pile, such as, for example, a sonar or an explosive, such as a sea mine, or a cavitating propeller of a vessel can also produce so much noise that this may result in damage to animals and humans in the vicinity of the sound source.

SUMMARY

A device for passively reducing the noise vibrations in a liquid resulting from a sound source which is arranged below the liquid level of a body of water includes a noise insulating pipe designed to be around the sound source. The pipe includes a number of telescopically extendable and retractable pipe sections and fastening means for attaching at least one first and one second pipe section to one another in the extended and/or retracted position. The fastening means are designed to allow the mutual displacement of the pipe sections in a starting position and to attach the pipe sections to one another in a fastening position. The fastening means are also designed to keep the first and second pipe sections substantially acoustically disconnected in the fastening position.

A method for passively reducing the noise vibrations in a liquid resulting from a sound source which is arranged below the liquid level of a body of water includes telescopically retracting or extending pipe sections in order to decrease or increase the length of the pipe; and attaching at least one first and one second pipe section to one another by operating fastening means which are designed to allow the mutual displacement of the pipe sections in a starting position and to attach the pipe sections to one another in a fastening position.

The fastening means are also designed to keep the first and second pipe sections substantially acoustically disconnected in the fastening position.

BRIEF DESCRIPTION OF THE DRAWINGS

Further advantages, features and details of the present invention will be explained with reference to the description of some preferred embodiments thereof. In the description, reference is made to the attached figures, in which.

DETAILED DESCRIPTION

Figure 1A:
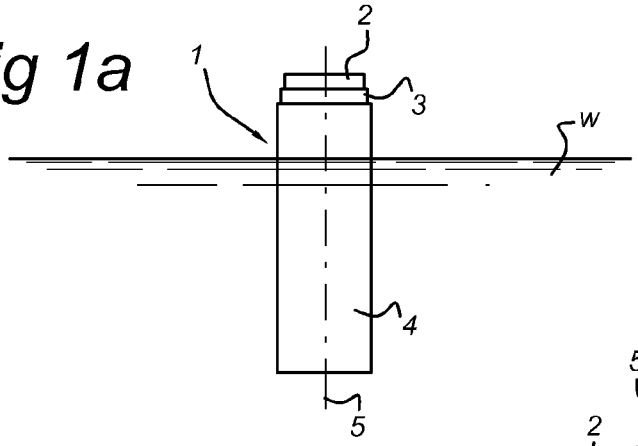
FIG. 1*a* shows a perspective view of a pipe floating in a body of water, in the retracted state.

It is possible to screen off the noise generated by the sound source from the surroundings by surrounding the sound source with an elongate tube or pipe. To this end, for example, a number of steel pipe sections can be welded together beforehand, for example on land or on a vessel, after which the assembly of pipe sections has to be transported to the sound source, lowered into the water and accurately positioned around the sound source. The pipe then rests on the bottom of the body of water, while the upper side of the pipe will preferably remain above water level. Due to the fact that the sound source is situated inside the interior of the pipe, the pipe wall can screen off the noise generated from the surroundings around the pipe, which may result in a significant reduction in the noise level in the vicinity.

One disadvantage of this method is that, especially with relatively long pipe lengths, for example in the case of a relatively deep body of water, transporting the pipe, lowering it into the water, arranging it around the sound source and securing it to the bottom is a fairly time-consuming and costly operation.

A further disadvantage is the fact that the rigidly coupled pipe sections conduct noise, in particular contact noise, particularly well, so that contact noise occurring in a particular pipe section (vibrations), is to a large degree transmitted to the other pipe sections. These (sound) vibrations may be damaging, for example because they may result in an underwater noise level which is unacceptably high for the surroundings.

DE 10 2006 008095 A1 in the name of MENCK GMBH discloses a pile and a sleeve which surrounds it. The sleeve has an inner wall and an outer wall which make up a sandwich-type construction. Between the inner wall and the outer wall, sound-insulating material is located which connects the inner wall and the outer wall to one another along the entire periphery, but this may cause undesired transfer of noise vibrations, in particular underwater.

It is an object of the present invention to provide a device and method in which the abovementioned disadvantages and/or disadvantages associated with the prior art can be eliminated or can at least be reduced.

It is another object of the invention to provide a device which can be placed in a body of water quickly and efficiently and at a desired length.

It is another object of the invention to provide a pipe assembly in which the transmission of sound, in particular the transmission of contact noise, between the individual pipe sections is reduced.

It is yet a further object of the invention to provide a method by means of which the length of a pipe can quickly and efficiently be adapted as desired.

According to a first aspect of the present invention, at least one of the objects is achieved by a device of the kind mentioned in the preamble, wherein the device comprises a noise-insulating pipe which is designed to be arranged around the sound source, the pipe comprising:

a number of telescopically extendable and retractable pipe sections;

fastening means for attaching at least one first and one second pipe section to one another in the extended and/or refracted position, wherein the fastening means are designed to allow the mutual displacement of the pipe sections in a starting position and to attach the pipe sections to one another in a fastening position, wherein the fastening means are also designed to keep the first and second pipe sections substantially acoustically disconnected in the fastening position.

The pipe sections can be telescopically displaceable with respect to one another between a completely retracted position in which the pipe has a relatively small total length and a completely extended position in which the pipe has a relatively large total length, but the pipe sections can also be brought to any arbitrary intermediate position between the completely retracted and completely extended position. In the retracted position, the total length is relatively small, so that the pipe can be readily handled and can be transported relatively easily, for example on the deck or in the hold of a ship. Once they have arrived at their destination, the pipe sections can be pulled out and the pipe is extended until the desired total pipe length has been reached.

In addition, the fastening means are designed such that transmission of, in particular, contact noise via the fastening means between the first and second pipe sections (and further pipe sections) is strongly reduced. Typically, with certain embodiments, a reduction of 20 dB or more can be achieved in the case of a double-walled pipe and a reduction of at least 3 dB in the case of a single-walled steel pipe.

In an embodiment of the invention, the fastening means comprise one or more radially displaceable spacers, such as for example in the form of a radially displaceable rod or ring or, in a particularly advantageous embodiment, in the form of an inflatable part. Once the pipe sections have been retracted or extended sufficiently and the pipe has reached its desired length, the spacers are operated, for example by displacing them radially inwards from an outer pipe section and/or radially outwards from an inner pipe section until the opposite pipe section is securely clamped. In a further embodiment, the spacers are designed such that the contact surface between the pipe sections is relatively small and thus a certain reduction of the sound transmission between the pipe sections between themselves can be achieved. Instead thereof or in addition thereto, a reduction in the contact noise transmission can be achieved by designing the fastening means to be at least partly elastic. The elastic spacers may, for example, be provided with resilient intermediate pieces so that the contact noise always has to pass through an elastic or resilient part in order to be transferred from one pipe section to the next pipe section. In the abovementioned advantageous embodiment, the spacer may comprise, for example, an inflatable elastic part. In the inflated state, the pipe sections are coupled to one another in an elastic manner and in deflated state, the pipe sections are disconnected and can be displaced with respect to one another.

In an embodiment of the invention, a spacer extends substantially completely around the respective wall of the pipe section. The spacer may, for example, comprise an inflatable sealing O-ring. In particular, the spacer may in this case form a sealing between the intermediate space on the one hand and the outside world on the other hand. This reduces noise transmission from the intermediate space to the outside.

In some embodiments, one spacer is sufficient to attach two pipe sections to one another, in other embodiments, the fastening means comprise two or more spacers which are arranged in different axial positions. In this case, the spacers may be provided in only one of the two adjacent pipe sections or in both pipe sections.

In a further embodiment, the fastening means are provided near one or both ends of the respective pipe section. This makes a relatively significant modification of the length of the pipe possible.

In some embodiments, the pipe sections themselves are single-walled, for example made of steel, concrete or a similar material. In other embodiments, however, the pipe sections are specifically made to insulate noise. In embodiments of the invention, a pipe section comprises at least one outer wall, an inner wall and an intermediate space situated between the outer and inner walls. In this case, the intermediate space can contain a noise-insulating medium, such as a gaseous substance (such as air) and/or noise-insulating material, in particular noise-absorbing material and/or anti-reverberation material. The noise-insulating material may, for example, be formed by anti-reverberation compound provided against one or both pipe section walls and rock wool or mineral wool provided in the intermediate space (i.e. the cavity). The last-mentioned materials result in a reduction in the reverberation time in the intermediate space and thus in an improvement of the insulation of (air) noise incident on the inner wall.

When the device is used for insulating a sound source placed below the water level of a body of water, it is preferable to make the pressure of the gaseous substance lower than the ambient pressure of the air above the body of water. The pressure may in this case be as low as 0.5 bar or lower, for example 0.1 bar or lower still. As will be explained below, the last-mentioned case would be referred to as a "vacuum" in the intermediate space(s).

It is possible for the mutual friction which occurs during retracting and extending of the pipe sections to be so great that the pipe sections are less readily retractable and extendable. It is also possible that this friction may damage the pipe sections in the long run. With certain embodiments of the invention, it has been an object to provide a device in which the friction during installation of the pipe and removal thereof, more particularly during increasing and decreasing the total length of the pipe by extending and retracting the pipe sections, respectively, is reduced.

According to a further aspect of the invention, a device of the kind mentioned in the preamble is provided to this end, the pipe comprising:

a number of telescopically extendable and retractable pipe sections;

fastening means for attaching at least one first and one second pipe section to one another in the extended and/or refracted position, wherein the fastening means are designed to allow the mutual displacement of the pipe sections in a starting position and to attach the pipe sections to one another in a fastening position;

guide means arranged between the first and second pipe sections for guiding the pipe sections during displacement with respect to one another.

These guide means may ensure that the friction-sensitive parts of pipe sections do not touch one another during displacement, so that the risk of wear as a result of such friction is prevented. Furthermore, the guide means may in some cases make it possible to make retracting or extending the pipe sections run more smoothly.

The latter advantage occurs in particular with embodiments of the invention in which the guide means form a roller guide. In this case, the rolling resistance is so small that little friction occurs when the pipe sections are displaced. The roller guide preferably comprises a number of wheels, in particular a number of wheels which extend in the axial direction and protrude radially outwards with respect to an inner pipe and/or radially inwards with respect to an outer pipe. In addition, the wheels are preferably arranged so as to be evenly distributed over a number of positions along the periphery, which improves the rolling properties.

In some embodiments of the invention, the fastening means may comprise one or more displaceable spacers which are designed to make contact between the guide means and an opposite pipe section possible in the starting position and to keep the guide means clear of the opposite pipe section in the fastening position. The term "clear" in this context is intended to mean that the respective elements are acoustically separated from one another in such a manner that there is no, or virtually no, contact noise transmission between opposite pipe sections via the guide means. This may be achieved, for example, by placing an elastic part between the elements so that adjacent pipe sections can be clamped against one another by means of the elastic part.

In some embodiments of the invention, the wheels partly extend in the intermediate space of the respective pipe section and partly outside thereof. In particular, the wheels extend radially outwards beyond the outer side of the outer wall of the first pipe section and/or radially inwards beyond the outer side of the inner wall of the second pipe section. More generally, the roller guide, in some embodiments of the invention, protrudes radially with respect to the outer side of the pipe section over a predetermined first distance ($a_1$). In addition, the expandable spacer, in the non-expanded state, protrudes over a predetermined second distance ($a_2$) and, in the expanded state, over a predetermined third distance ($a_3$), wherein the second distance is smaller than the first distance ($a_2<a_1$) and the third distance is greater than the first distance ($a_3>a_1$). The second distance may also be 0 or even negative if the expandable part of the spacer has been retracted into the respective pipe section. However, the important thing is that, in the expanded state, the distance between successive pipe sections created by the spacers is so large that the roller guide, in particular the wheels, of a particular pipe section no longer make contact with the adjacent pipe section. More generally, the fastening means are designed to be displaced between a starting position, in which the guide means are operational and the pipe sections are displaceable between the retracted and the extended position, and a fastening position, in which the guide means are not operational and the pipe sections are attached to one another.

In an advantageous embodiment of the invention, the inner and outer walls of a pipe section are substantially detached from one another. The inner and outer walls would therefore be able to move with respect to one another. In particular, a pipe section may be composed of two separate pipes which are not attached to one another until the pipe has reached its intended destination. The inner and outer walls may, for example, both have a stop so that one wall can rest on the other wall in the axial direction, for example during transportation of the pipe. In order to prevent the outer and inner walls from being excessively acoustically coupled in use via these stops, which may reduce the noise reduction of the pipe, one or more elements reducing the sound transmission are provided between the stops in a further embodiment.

Such elements reducing the sound transmission may be formed by one or more of the abovementioned spacers which are, however, arranged in such a manner that they are displaceable not so much in the radial direction, as in the axial direction. In the starting position, the one pipe section wall rests on the other pipe section wall and the combination of both pipe section walls can be displaced in order to extend the pipe to its desired full length. When the desired length is reached, the axial spacers are displaced in the axial direction so that there is no longer any contact between the stops. More particularly, in this position, there is substantially no contact at all between the outer and inner walls of the respective pipe section except for the (sound-reducing) spacers.

Then, the radial spacers are displaced in the radial direction as well. In this position, the only contact between the first and second pipe sections is formed by said spacers. These are made so as to insulate against noise (vibration), so that little sound transmission, in particular contact noise, occurs between the two pipe sections.

In a particular embodiment, the pipe composed of a number of telescopically displaceable pipe sections comprises a relatively light pipe section and a relatively heavy pipe section, wherein the heavy pipe section can be extended with respect to the light pipe section substantially without an external drive under the effect of the force of gravity.

According to another aspect of the invention, a method is provided for passively reducing the noise vibrations in a liquid resulting from a sound source which is arranged below the liquid level of a body of water, wherein the device comprises a pipe which is composed of a number of telescopically displaceable pipe sections, the method comprising:

telescopically retracting or extending pipe sections in order to decrease or increase the length of the pipe;

attaching the at least one first and one second pipe section to one another by operating fastening means which are designed to allow the mutual displacement of the pipe sections in a starting position and to attach the pipe sections to one another in a fastening position, wherein the fastening means are also designed to keep the first and second pipe sections substantially acoustically disconnected in the fastening position.

The attachment of the pipe sections may involve displacement of one or more spacers in the radial direction. The spacers are then displaced in such a way that the opposite pipe section is securely clamped.

The method may furthermore comprise displacement of a spacer in the radial direction until it protrudes over a predetermined distance ($a_3$), wherein the predetermined distance is sufficiently large to provide no further contact between the first and second pipe sections. As a result thereof, there is only a limited contact surface between the pipe sections (depending on the embodiment of the spacer, there are, for example, only a number of spot connections or one or more line connections). For the same reasons, the method may furthermore comprise displacement of the axial spacers in the axial direction, if the pipe is of a kind where the inner and outer walls of a pipe section can rest on one another in the axial direction via respective stops and wherein one or more axial spacers which are displaceable in the axial direction are positioned between the stops. The axial spacers are displaced to such a degree that there is substantially no further contact between the outer and inner walls other than via the respective spacer.

FIG. 1*a* shows an embodiment of a device according to the invention. The device comprises a pipe 1 which is provided, in a manner which is not illustrated, with buoyancy so that it can float in a body of water (w). The pipe 1 comprises a large number of individual pipe sections 2-4, only three of which have been illustrated in order to simplify the drawing. It is clear that, in practice, the number of pipe sections may vary.

Although this has not been illustrated in the figures, a pile element may be arranged in the pipe in a particular embodiment of the invention. This pile element can subsequently be driven into the bottom by means of a pile-driving device (not shown). Ramming pile elements into the bottom of the body of water generates a lot of noise and in this embodiment, it is the pile element which forms the abovementioned sound source. The pile element may be rolled on the inner side of each of the pipe elements along wheels (not shown) so that, during ramming, the pile-driving device is not, or hardly, adversely affected by the presence of the pipe around the pile element.

The pipe sections 2-4 are arranged telescopically with respect to one another, that is to say that pipe section 4 can be displaced in the axial direction (that is to say along the longitudinal axis 5 of the pipe 1) with respect to pipe section 3 and pipe section 3 with respect to pipe section 2. However, in the starting position illustrated in FIG. 1A, the pipe sections are fixed with respect to one another, so that the pipe sections remain retracted while floating in the water.

At a certain point in time, the fixation of the pipe sections with respect to one another is released, so that the pipes can move with respect to one another. In the illustrated embodiment, the last pipe section 4 is designed to be so heavy that it also carries along the other pipe sections when it is extended. Once the extreme extended position is reached (as is illustrated in FIG. 1), a stop (not shown) ensures that pipe section 4 does not move any further. During displacement of pipe section 4 or when the pipe section 4 is blocked by the stop, pipe section 3 will also be carried along with respect to pipe section 2 and move with respect to the second pipe 2.

Figure 1B:
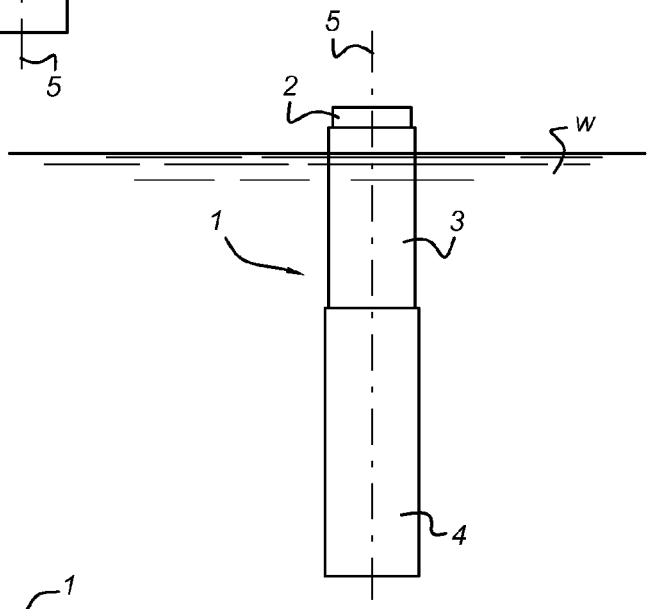
FIG. 1*b* shows the pipe from FIG. 1*a* floating in the water, in the extended state.
Figure 1C:
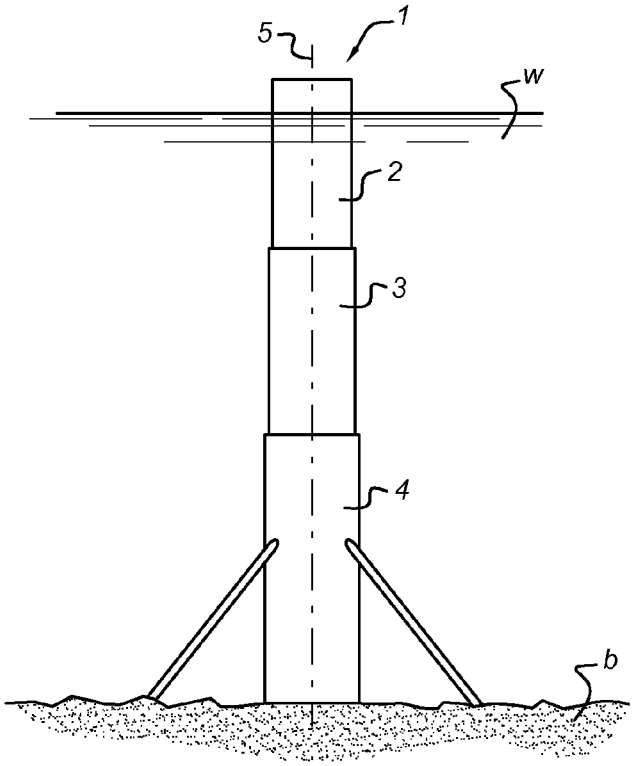
FIG. 1*c* shows a perspective view of a pipe arranged on the bottom of the body of water.

FIG. 1C shows the situation in which the pipe is placed on the bottom (b) of the body of water (w) and is anchored therein. In this position, the pipe sections 2, 3 and 4 are completely extended with respect to one another and attached to one another in a way which is to be discussed in more detail.

Figure 2:
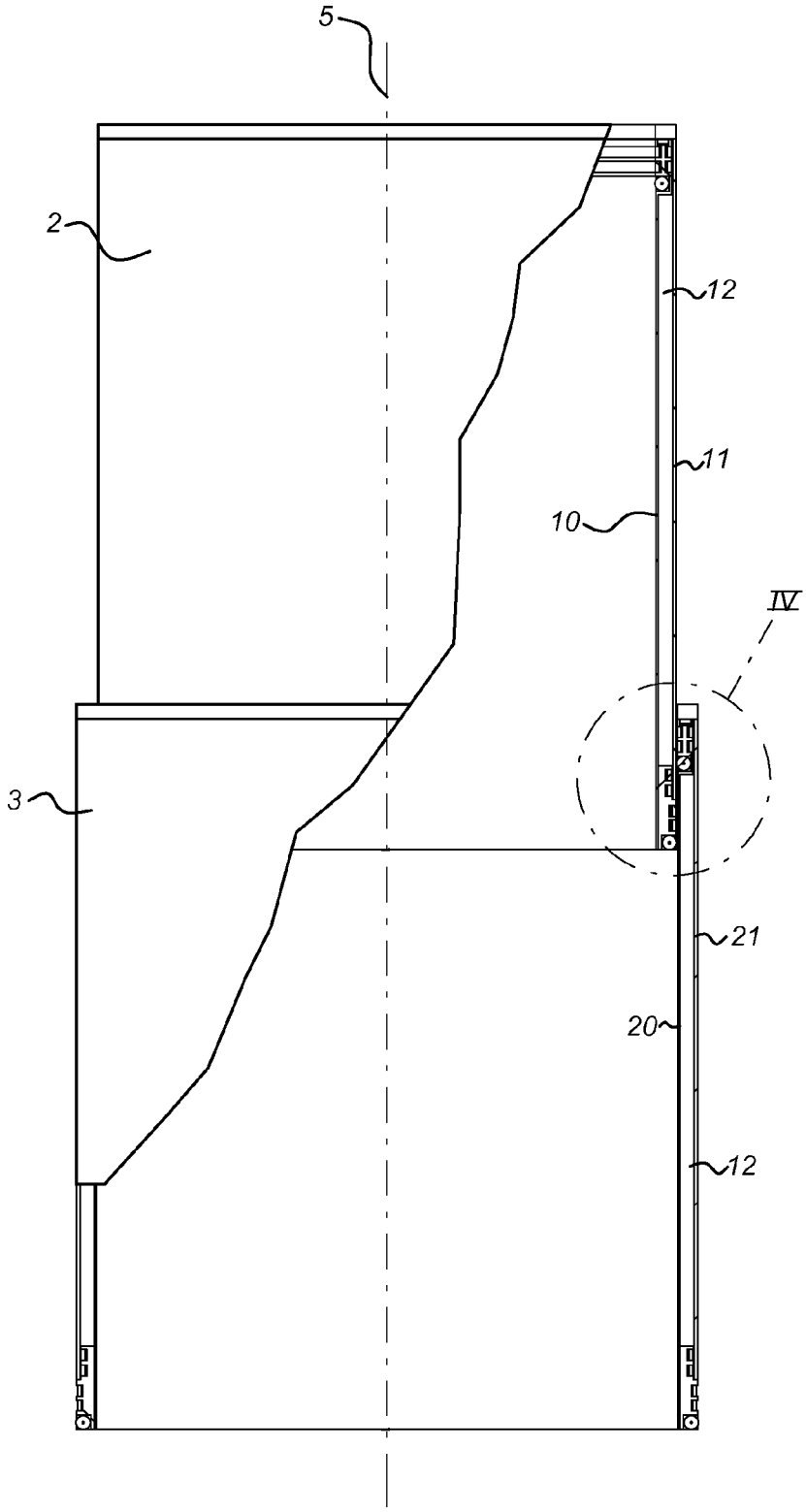
FIG. 2 shows a more detailed perspective view, partly cut-away, of a specific embodiment of a first and second pipe section of a pipe assembly according to the invention.
Figure 3A:
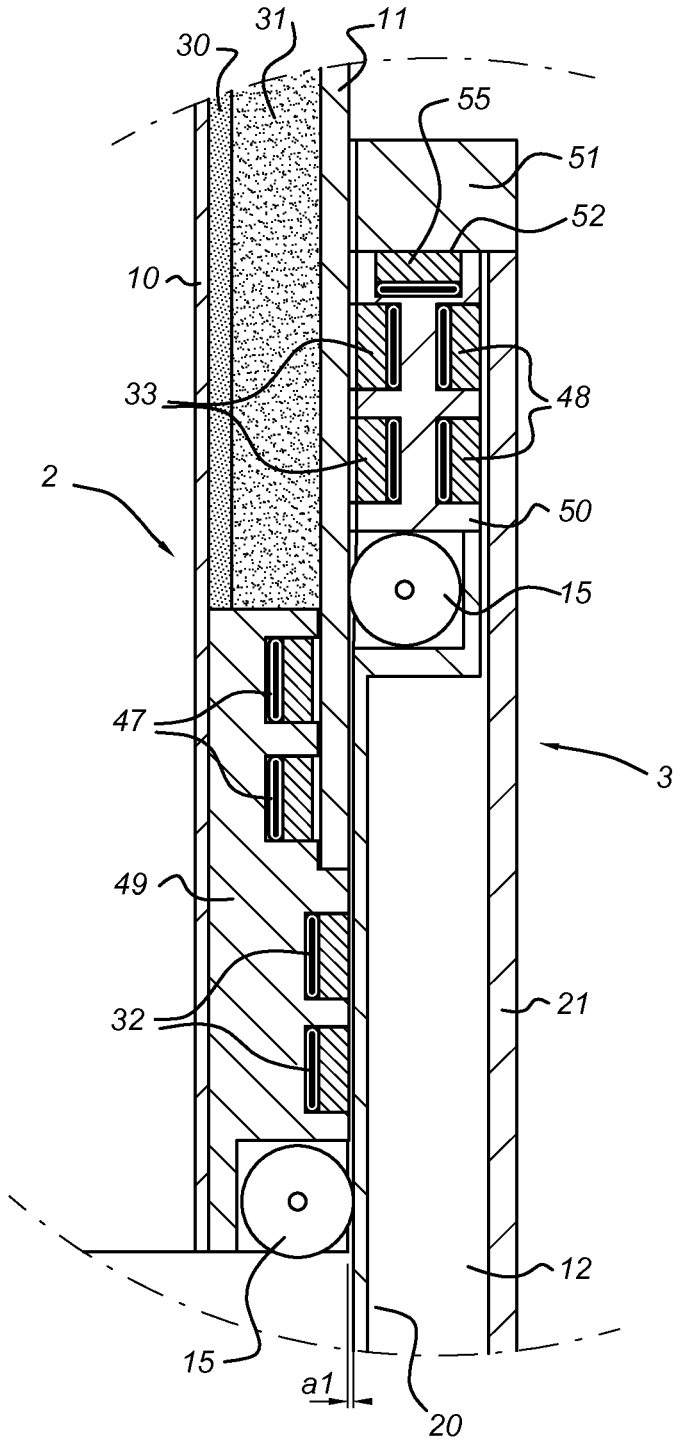
FIGS. 3*a* and 3*b* show enlargements IV from FIG. 2, in a starting position and in a fastening position, respectively.
Figure 3B:
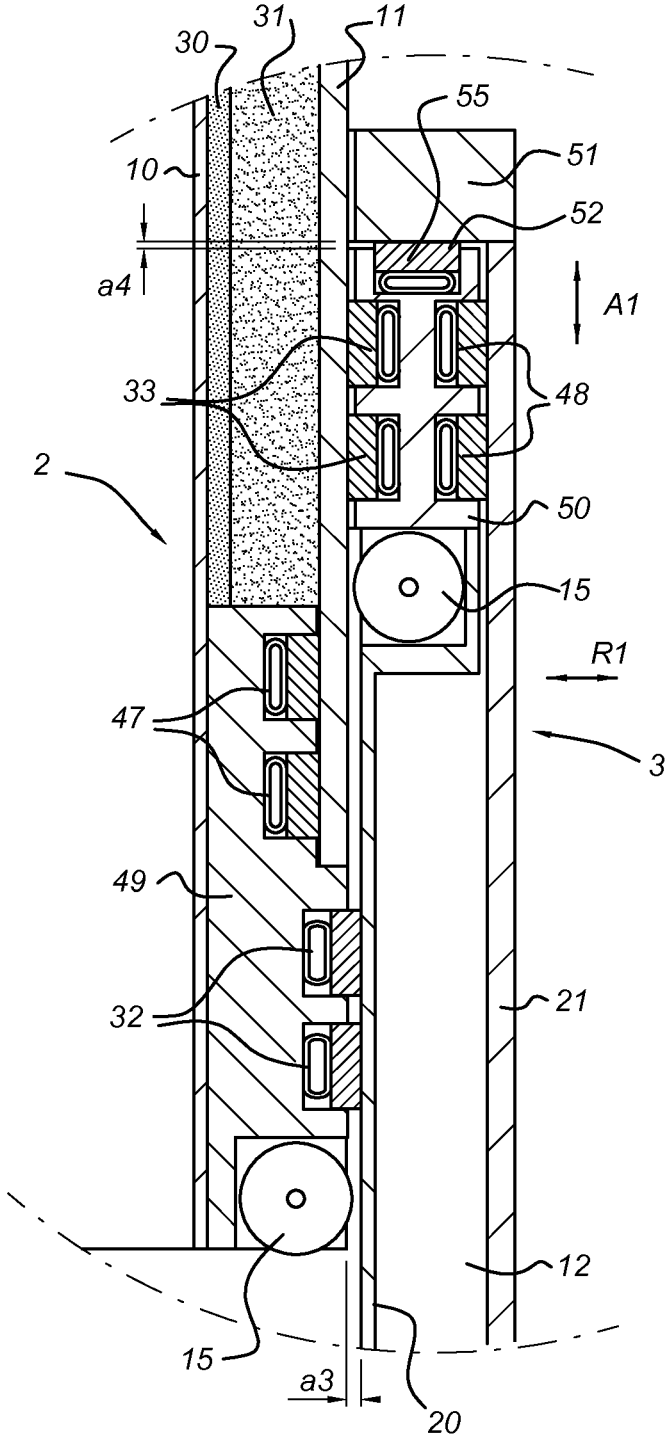

Although a single-walled embodiment of the pipe sections is possible, the pipe sections in the embodiments illustrated in FIGS. 2 and 3*a*, 3*b* are multi-walled. In this embodiment, each pipe section 2, 3 is composed of an inner wall 10,20 and an outer wall 11,21. The outer and inner walls are placed concentrically with respect to one another, with an intermediate space 12 being present between the outer and inner walls. In another embodiment (not shown), several pipe sections are placed around one another, so that more intermediate spaces are produced.

Said intermediate space 12 forms a pressure chamber in which a reduced pressure can be created, for example by pumping water out of the intermediate space. Therefore, intermediate spaces 12 are sealed at the top and at the bottom in this embodiment. Due to the reduced pressure in the intermediate space 12, the transfer of the noise generated in the medium (water and/or air) inside the pipe (that is to say the medium-borne sound) to the surroundings can be reduced further. In the intermediate spaces 12, which effectively function as a cavity between the outer and inner walls 10,11,20,21, noise-absorbing material can be introduced, for example in the form of a layer 31 of mineral wool or rock wool. In addition thereto or instead thereof, a layer of anti-reverberation compound 30 is attached to the inner wall and/or the outer wall in the other embodiments, which layer provides a degree of anti-reverberation of the respective pipe wall (often made of steel). The sound insulation against the noise generated in the pipe wall 10,20 itself (that is to say the "structure-borne sound" or contact noise) is not so much affected by the low pressure in the intermediate spaces 12, as by the degree of coupling between the inner wall 10,20 and outer wall 11,21 of the pipe sections. In the following, a structure is described in which the contact noise generated by the sound source is also sufficiently insulated.

In order to facilitate retracting and extending of the pipe sections 2, 3 between the retracted and extended positions and to reduce the resulting friction forces, roller guides are provided in the outer wall 11 of the first pipe section 2 and in the inner wall 20 of the second pipe section 3, in the illustrated embodiment in the form of a number of wheels 15. These wheels run in the axial direction and protrude substantially in the radial direction with respect to the outer wall 11 and inner wall 20, respectively, of the first and second pipe sections 2, 3, respectively. The distance over which the wheels 15 extend with respect to the respective wall has in this case been chosen to be relatively small ($a_1$), as is illustrated in FIGS. 3*a* and 3B. Thus, the pipes roll over one another, as it were, when the pipe sections are being retracted and extended, so that there is relatively low friction between the pipe sections.

Once the pipe sections 2, 3 have reached the extended state, as is illustrated, for example, in FIG. 2, the pipe sections still have to be attached to one another and in such a manner that transmission of noise, and in particular contact noise, between the pipe sections 2, 3 is kept to a minimum. If, for example, the inner wall 20 of the second pipe section 3 would rigidly adjoin the outer wall 11 of the first pipe section 2, contact noise, that is to say the vibrations resulting from a sound source situated in the inner space 6 of the pipe, would be transferred directly from the inner wall 20 to the outer wall 11. Outer wall 11 of the first pipe section is in direct contact with the body of water and can thus readily transfer the noise to the body of water again. This would greatly reduce the contact noise insulation of the pipe 1.

However, in the illustrated embodiment, the pipe sections 2, 3 are coupled to one another in such a manner that relatively little sound transmission, in particular contact noise transmission (vibrations) takes place between the inner wall 20 of the second pipe section 3 and the outer wall 11 of the first pipe section 2. To this end, use is made of a number of spacers 32 which are provided on the lower side of the first pipe section 2 and a number of spacers 33 which are provided on the upper side of the second pipe section 3. The spacers 32,33 are designed to create sufficient distance between the outer wall of the first pipe section and the inner wall of the second pipe section, so that the abovementioned wheels are no longer in contact with the wall of an opposite pipe section.

Figure 4:
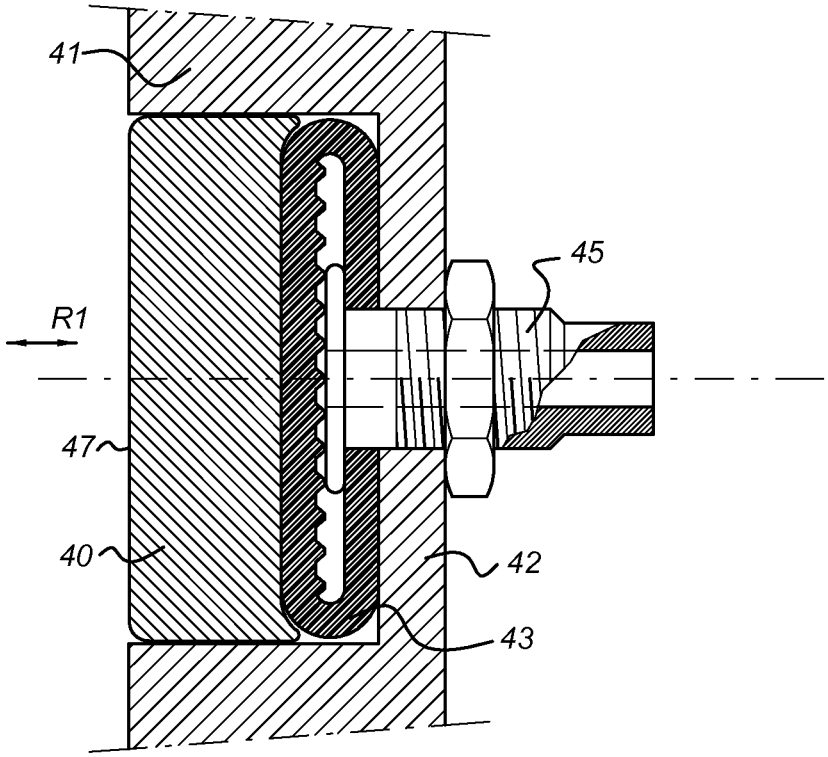
FIG. 4 shows a detail view of a particular embodiment of a spacer according to the invention.

FIG. 4 shows such a spacer in more detail. The spacer comprises an elastic block 40 which, in the illustrated embodiment, forms a closed ring, more particularly an O-ring. This ring may, for example, be made from a wear-resistant and slightly elastic material, for example rubber. In the starting position illustrated in FIG. 4, the block 49 is completely or virtually completely accommodated in a holder 41 which is fixedly attached to the respective wall of the second and first pipe section 3, 2. On the inner side 40 and the bottom 42 of the holder, an inflatable sealing 43 is provided. This sealing 43 runs substantially completely around the pipe and thus forms a substantially O-shaped ring (also referred to as the O-ring below for short).

The inner side of the sealing 43 is connected to an air supply and air discharge duct 45. The duct 45 may (in a way which is not illustrated) be connected to a generator for supplying air to the O-ring sealing for expanding the latter or for withdrawing air from the O-ring sealing so as to retract it.

The spacers 32, 33 operate as follows. When the pipe sections 2, 3 have reached a position of use, that is to say, for example, the extended position as illustrated in FIG. 1B, air is supplied via the air supply/air discharge duct 45 by means of the generator, so that the inflatable ring expands. This results in the elastic block 40 being moved radially outwards (direction $R_1$, FIGS. 3*b* and 4). The distance over which the respective block is moved outwards, is so large that the front 47 of the block 40 protrudes over a distance ($a_3$) with respect to the outer wall 11 of the first pipe section 2 or the inner wall 20 of the second pipe section 3. This distance is so large that the roller guide, in particular the wheels 15, come away from the opposite pipe wall. This means that the wheels 15 in the first pipe section 2 come away from the inner wall 20 of the second pipe section 3, as is illustrated in FIG. 3*b*, while the wheels 15 on the upper side of the second pipe section come away from the outer wall 11 of the first pipe section. Said distance ($a_3$) therefore has to be greater than the abovementioned distance ($a_1$) by which the wheels protrude with respect to the pipe section in which they are fitted. In this state, the only contact between successive pipe sections 2, 3 is in fact formed by the spacers 32, 33 and the pipe sections 2, 3 are otherwise detached from one another. As the contact surface between the pipe sections is limited as a result thereof (more particularly is limited to four line contacts if O-rings are used), this means that only a relatively small part of the contact noise can be transferred to the opposite pipe section. As, moreover, the spacers 32, 33 are designed to be partly elastic, at least are designed such that the path traveled by the contact noise is always interrupted by an elastic part, in the illustrated case the abovementioned block 40 in combination with the O-ring 32, a further reduction of the sound transmission can be achieved.

One embodiment which uses radially displaceable spacers for attaching pipe sections to one another can be used for pipe sections of different kinds. It is possible to provide the spacers in single-walled pipe sections, such as for example in the embodiment from FIG. 6, in which the spacers ensure that the contact noise which is generated in the pipe wall of a certain pipe section cannot spread or at least cannot readily spread to other pipe sections. This ensures that only the outer wall of a single pipe section can transmit the contact noise to the surroundings. In other embodiments, such as for example illustrated in FIG. 5, the pipes are multi-walled, for example double-walled or provided with even more walls, with the intermediate space(s) between the walls acting in a noise-insulating manner. The outer wall and inner wall of such a pipe section have to be separated from one another as much as possible in order to reduce the sound transmission (via connections) from the inner wall to the outer wall. This can be achieved, for example, by making the connection between outer and inner walls from flexible material and/or by limiting the number of connections and the length of the connections.

In the embodiment illustrated in FIGS. 3*a* and 3*b*, the outer and inner walls of each pipe section are, for example, connected via a number of spacers of the same or similar type as described earlier. FIG. 3*a* shows two spacers 47 which are provided in the first pipe section 2 and two spacers 48 which are provided in the third pipe section 3. The spacers 47, 48 are fitted in respective supports 49, 50 which are attached to the inner wall 10 of the first pipe section 2 and the inner wall 20 of the second pipe section 3. The spacers work in a similar way to that which has been described above and can be expanded in the axial direction in order to clamp the respective inner wall with the support 49, 50 attached thereto against the associated outer wall.

Below, the design of the pipe sections as illustrated in FIGS. 3*a* and 3*b* will be discussed in more detail. Reference is repeatedly made to an outer pipe, such as for example the second pipe section 3, the upper side of which is arranged on the outside around the lower side of the first pipe section. The design of the other pipe sections is substantially identical and a detailed description thereof is therefore omitted here.

The second pipe section 3 comprises an inner pipe 20, to which a support 50 is attached in the above-described way. This support 50 is provided with a number of wheels 15 which are distributed over the peripheral surface of the pipe and with a number of O-rings 33 (in the illustrated embodiment two). The second pipe section 3 also comprises an outer wall 21 which is, in principle, detached from the abovementioned inner wall 20 and support 50. On the upper side, the outer wall 20 is provided with a stop 51 which can rest on the upper side 52 of the support 50 of the inner wall 20. Furthermore, a support 50 is provided with an axial spacer 55, in addition to the abovementioned radial spacers 48, 33. The design of this axial spacer 55 is similar or identical to that of the abovementioned axial spacer 48, 33, but is oriented such that a desired distance can be achieved in the axial direction (direction $A_1$, FIG. 3*b*) instead of in the radial direction ($R_1$). When the axial spacer 55 expands, an intermediate space 58 (over a distance (a4)) is created, so that at the upper side of the second pipe section 3 only the inner wall 20, support 50 and outer wall 21 are in contact with one another via the respective spacer 55. Even when the axial spacers 48 are expanded (in the state in which the abovementioned axial spacers 33 are also expanded so that the inner wall 20 of the second pipe section 3 is placed at a distance from the first pipe section 2) the inner wall 20 with the support 52 attached thereto is clamped securely, as it were, between the outer wall 11 of the first pipe section 2 and the outer wall 21 of the second pipe section 3. In this state, the outer wall 21 is clamped in such a way that it can no longer be displaced in the axial direction. In this state, the only connections between the inner wall 20, on the one hand, and the outer wall 21, on the other hand, are formed by the axial spacer 55 and the two radial spacers 48. This means that there is only a very small coupling surface between the outer and inner walls, as a result of which the sound transmission from the inside to the outside can remain relatively small. Due to the fact that, moreover, all spacers are designed to more or less insulate against vibrations, the transmission of vibrations from the inner wall 21 to the outer wall 20 can be reduced further.

When a pipe which has been installed has to be removed again from the bottom of the body of water, the axial and radial spacers are retracted again, so that the different pipe sections 2, 3, 4 can readily and with little friction be pushed back into the retracted position via the roller guides (wheels 15). In the retracted position, the spacers can be expanded so as to keep the pipe sections secured in this position.

Figure 5:
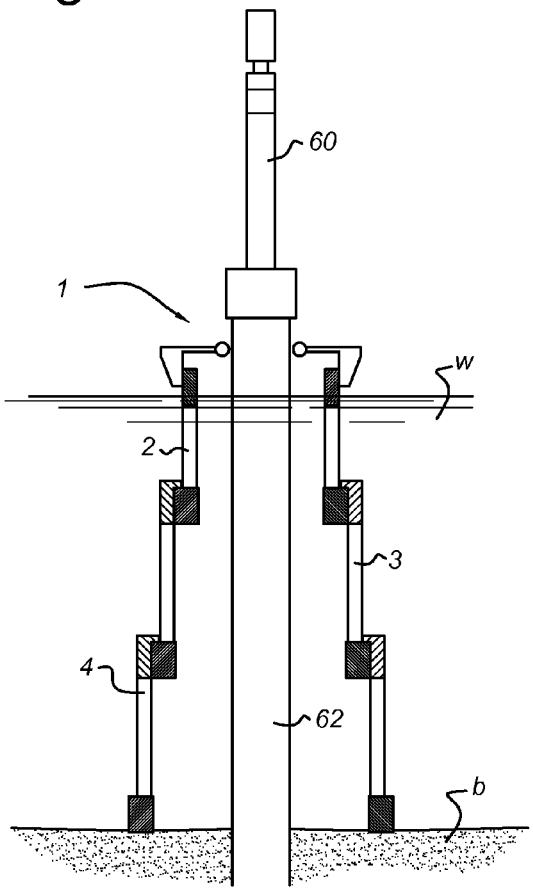
FIG. 5 shows a diagrammatic longitudinal section of a further embodiment of the invention for reducing noise generated by a sound source.
Figure 6:
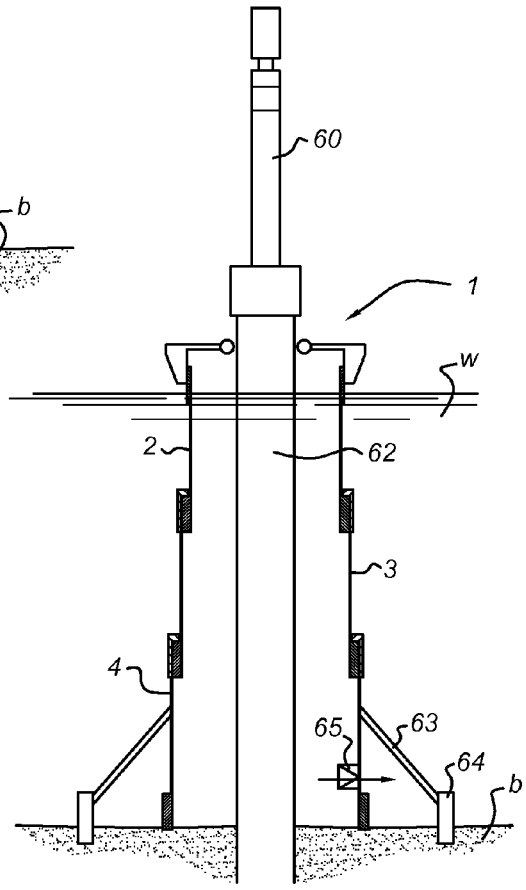
FIG. 6 shows a diagrammatic longitudinal section of yet another embodiment of the invention.

FIGS. 5 and 6 show examples of the use of a telescopic pipe 1 according to the present invention. In the illustrated embodiment, the pipe 1 is substantially made of steel, but other kinds of material are of course also possible, such as concrete or a composite material. A sandwich-construction made of composite material, in which the core of the sandwich acts as an insulation against the transmission of vibrations, is an option. FIGS. 5 and 6 both show a pile-driving device 60 by means of which a pile element 62 can be rammed into the bottom (b) of a body of water (w). An embodiment of the pipe 1 is arranged around the pile element 62. The pipe 1 comprises a number of pipe sections 2, 3, 4 which, according to the embodiment illustrated in FIG. 5, are each composed of a pipe of the abovementioned double-walled type and, according to the embodiment illustrated in FIG. 6, of a single-walled type.

FIGS. 5 and 6 furthermore show that, on the lower side of the pipe, a number of (for example three) adjustable suction piles 64 are provided which are preferably distributed evenly over the periphery of the pipe. These piles can be anchored to a greater or lesser degree into the bottom in a manner which is known per se. By anchoring the piles more or less deep into the bottom and/or by adjusting the connecting elements 63 between the pipe 1 and the suction piles 64, the pipe can be fixed in the correct position with respect to the bottom.

The dimensions of the pipe vary, depending on the dimensions of the sound source. If the sound source is formed by a pile or the like (the pile having a typical diameter of 4-6 meters or more), the diameter of the pipe 1 will, in practice, be 7 meters or more, so that there is sufficient distance between the sound source and the inner side of the pipe to prevent contact noise (that is to say transfer of noise by direct contact between the sound source and the pipe). Noise which is generated by the sound source will reach the respective inner walls of the pipe sections 2, 3, 4 via the water ($w_1$) which may be present in the pipe and/or the air which is present therein. However, due to the above-described noise-insulating construction, a large part of the noise (that is to say air noise and contact noise) will be insulated so that only a small part thereof will reach the respective outer wall of the pipe sections. Since only a small part of the noise reaches the outer walls, the level of the noise which is emitted by the pipe to the surroundings will be greatly reduced with respect to the situation where no noise-insulating pipe is provided around the sound source. Thus, the noise pollution to the surroundings can be significantly reduced.

In some embodiments, the pressure prevailing in the intermediate space is equal to or higher than the local air pressure because even at such pressures, a reduction of the sound transmission can be achieved. In other embodiments of the invention, however, the pressure in the intermediate space is reduced with respect to the ambient pressure. The pressure may in this case be as low as 0.5 bar or lower, for example 0.1 bar, or even lower. As a result of the reduced pressure, the propagation of the sound vibration can be affected. In another embodiment, pumping means are provided for partly emptying the central interior space 6 delimited by the pipe by pumping in order to achieve sound transmission from the sound source to the inner side of the pipe. When the sound source extends, for example, completely or partially above the water level $w_1$ in the interior space of the pipe, less noise will reach the inner wall of the pipe sections 2, 3, 4, due to the insulating action of the air in the interior space. When less noise reaches the inner wall, less noise will be emitted by the outer walls. More generally, the area without liquid transfers the noise from the sound source less readily to the surroundings.

In all embodiments (e.g. the embodiments illustrated in FIGS. 5 and 6), the pipe may be provided with one or more pumps (which are only illustrated diagrammatically in FIG. 6) which can reduce the water level in the interior space. Along the distance where the water level has dropped in the interior space, less noise is transferred from the sound source to the surroundings outside the pipe 1, so that the noise pollution for the vicinity is reduced further.

The present invention is not limited to the above-described embodiments thereof. Rather, the rights sought are determined by the following claims, the scope of which allows for numerous changes and modifications.

The invention claimed is:

1. A device for passively reducing the noise vibrations in a liquid resulting from a sound source which is arranged below the liquid level of a body of water, wherein the device comprises a noise-insulating pipe which is designed to be arranged around the sound source, the pipe comprising:

a number of telescopically extendable and retractable pipe sections; and fastening means for attaching at least one first and one second pipe section to one another in the extended and/or retracted position, wherein the fastening means are designed to allow the mutual displacement of the pipe sections in a starting position and to attach the pipe sections to one another in a fastening position, and wherein the fastening means comprise one or more displaceable spacers which can be expanded in an axial and/or radial direction to keep the first and second pipe sections substantially acoustically disconnected in the fastening position; and guide means arranged between the first and second pipe sections for guiding the pipe sections during displacement with respect to one another, wherein the one or more displaceable spacers are designed to make contact between the guide means and an opposite pipe section possible in the starting position and to keep the guide means clear of the opposite pipe section in the fastening position.

2. The device according to claim 1, wherein the reduction in contact noise between pipe sections is at least 3 dB with a single-walled embodiment of the pipe sections and at least 20 dB with a multi-walled embodiment of the pipe sections.

3. The device according to claim 1, wherein the fastening means are at least partly elastic in order to reduce the transmission of vibrations between the first and second pipe sections.

4. The device according to claim 1, wherein the fastening means comprise one or more radially displaceable spacers which are designed to clamp the pipe sections in the fastening position.

5. The device according to claim 4, wherein a spacer comprises an inflatable elastic part.

6. The device according to claim 4, wherein a spacer extends substantially completely around the respective wall of the pipe section.

7. The device according to claim 4, wherein a spacer comprises an inflatable sealing O-ring.

8. The device according to claim 1, wherein the fastening means comprise two or more spacers which are arranged at different axial positions.

9. The device according to claim 1, wherein the fastening means are provided near one or both ends of the respective pipe section.

10. The device according to claim 1, wherein the pipe sections are designed to insulate against noise, and comprise at least one outer wall, an inner wall and an intermediate space situated between the outer and inner walls, wherein an intermediate space contains a noise-insulating medium.

11. The device according to claim 10, wherein the intermediate space in a pipe section is at least partially filled with a gaseous substance, noise-insulating material, noise-absorbing material and/or anti-reverberation material.

12. The device according to claim 1, wherein the guide means form a roller guide, the roller guide comprising a number of wheels.

13. The device according to claim 1, wherein the fastening means are designed to be displaced between a starting position, in which the guide means are operational and the pipe sections are displaceable between the retracted and the extended position, and a fastening position, in which the guide means are not operational and the pipe sections are attached to one another.

14. The device according to claim 12, wherein the roller guide protrudes radially with respect to the outer side of the pipe section over a predetermined first distance ($a_1$) and wherein an expandable spacer, in the non-expanded state, protrudes radially over a predetermined second distance ($a_2$) and in the expanded state protrudes over a predetermined third distance ($a_3$), wherein the second distance is smaller than the first distance ($a_2<a_1$) and the third distance is greater than the first distance ($a_3>a_1$).

15. The device according to claim 1, wherein the inner and outer walls of a pipe section are substantially detached from one another and both have a stop so that one wall can rest on the other wall in the axial direction and wherein elements reducing the sound transmission are provided between the stops of the outer and inner walls.

16. The device according to claim 15, wherein the elements reducing the sound transmission comprise one or more spacers which are displaceable in the axial direction.

17. The device according to claim 1, comprising a relatively light pipe section and a relatively heavy pipe section, wherein the heavy pipe section can be extended with respect to the light pipe section substantially without an external drive under the effect of the force of gravity.

18. A system for passively reducing the noise vibrations in a liquid resulting from a sound source which is arranged below the liquid level of a body of water, the system comprising:

a device according to claim 1; and at least one sound source arranged in or to be arranged in the pipe.

19. A method for passively reducing the noise vibrations in a liquid resulting from a sound source which is arranged below the liquid level of a body of water with a device comprising a pipe which is composed of a number of telescopically displaceable pipe sections, the method comprising:

telescopically retracting or extending pipe sections using guide means in order to decrease or increase the length of the pipe; and attaching at least one first and one second pipe section to one another by operating fastening means which are designed to allow the mutual displacement of the pipe sections in a starting position and to attach the pipe sections to one another in a fastening position; and displacing one or more spacers in the radial and/or axial direction to keep the first and second pipe sections substantially acoustically disconnected and to keep the guide means clear of the opposite pipe section in the fastening position.

20. The method according to claim 19, wherein attachment of the pipe sections comprises:

displacing one or more spacers in the radial direction until the spacers securely clamp the opposite pipe section.

21. The method according to claim 19, wherein the spacers are expandable with respect to the outer wall of the first pipe section and/or with respect to the inner wall of the second pipe section, the method furthermore comprising:

displacing a spacer in the radial direction until it protrudes over a predetermined distance ($a_3$), wherein the predetermined distance is sufficiently large to provide no further contact between the first and second pipe sections.

22. The method according to claim 19, wherein the inner and outer walls of a pipe section can rest on one another in the axial direction via respective stops and wherein one or more axial spacers which are displaceable in the axial direction are positioned between the stops, the method furthermore comprising:

displacing a spacer in the axial direction until there is substantially no further contact between the outer and inner pipe sections between the outer and inner walls other than via the respective spacer.

23. The method according to claim 19, the method comprising:

arranging the pipe in the body of water wherein the pipe sections are in the retracted starting position;

extending at least the first and second pipe sections from the refracted starting position to the extended fastening position;

attaching the first and second pipe sections to one another; and placing the pipe sections over the sound source.

* * * * *